US005315844A

United States Patent [19]

Hansen

[11] Patent Number: 5,315,844

[45] Date of Patent: May 31, 1994

[54] LOW PROFILE CONCENTRIC HEAT PUMP WITH REVERSIBLE AIR FLOW

[76] Inventor: Laurits Hansen, 13 Ioanni Tsimiski Str. P.O. Box 4180, Limassol, Cyprus, Denmark

[21] Appl. No.: 923,799

[22] PCT Filed: Mar. 11, 1991

[86] PCT No.: PCT/EP91/00454

§ 371 Date: Oct. 29, 1992

§ 102(e) Date: Oct. 29, 1992

[87] PCT Pub. No.: WO91/14140

PCT Pub. Date: Sep. 19, 1991

[30] Foreign Application Priority Data

Mar. 15, 1990 [GB] United Kingdom ..... 9005664

[51] Int. Cl.[5] ..... F25B 29/00

[52] U.S. Cl. ..... 62/325; 62/499

[58] Field of Search ..... 62/499, 325, 324.6, 62/324.1

[56] References Cited

U.S. PATENT DOCUMENTS 3,389,577 6/1968 Kemp ..... 62/499

3,623,332 11/1971 Fernandes .

4,726,198 2/1988 Ouwenga ..... 62/499

FOREIGN PATENT DOCUMENTS 1292088 10/1972 United Kingdom .

*Primary Examiner*—John M. Sollecito

*Attorney, Agent, or Firm*—Kane, Dalsimer, Sullivan, Kurucz, Levy, Eisele and Richard

[57] ABSTRACT

The heating or cooling apparatus includes a heat pump further including a compressor, a radiator portion, an expansion valve and a cooling portion, the heat pump being constructed in the form of a thin rotatable wheel wherein the cooling portion forms a radially inner portion of the wheel and the radiator portion forms a radially outer portion of the wheel, the wheel having a plurality of fins which, when the wheel rotates, drive stream of air over the cooling portion and the radiator portion, and a housing enclosing the wheel and having means for separating the streams of air and directing them in desired directions.

11 Claims, 5 Drawing Sheets

LOW PROFILE CONCENTRIC HEAT PUMP WITH REVERSIBLE AIR FLOW

The present invention relates to a heating or cooling apparatus. The apparatus is suitable for use in an air conditioning system.

Air conditioning apparatus is used in a wide range of situations, such as in buildings and large vehicles, for cooling or warming the ambient air to a comfortable temperature. Such apparatus generally includes a heating and cooling apparatus which warms the ambient air during cool weather, and extracts heat from the ambient air when the weather is hot and cooling is required.

Most known air conditioning apparatus is manufactured as separate units, such as compressors, evaporators, condensers and so on, which are connected together in situ. The resulting apparatus is expensive, making it unsuitable for many domestic premises, and being large and complicated, is difficult to install in small vehicles. Further, because the apparatus has many parts, it requires frequent maintenance and tends not to be very reliable. There is therefore a need for a heating or cooling apparatus suitable for use in an air conditioning system, which is small and light, and inexpensive to manufacture and install.

According to the present invention there is provided a heating or cooling apparatus including a heat pump comprising a compressor, a radiator portion, an expansion valve and a cooling portion, the heat pump being constructed in the form of a thin rotatable wheel wherein the cooling portion forms a radially inner portion of the wheel and the radiator portion forms a radially outer portion of the wheel, the wheel having a plurality of fins which, when the wheel rotates, drive streams of air over the cooling portion and the radiator portion, and a housing enclosing the wheel and having means for separating the streams of air and directing them in desired directions.

A thin wheel is one in which the thickness of the wheel is less than half its diameter. Advantageously, the thickness of the wheel is less than one quarter of its diameter, and in the embodiment shown in the drawings, the wheel's thickness is less than one eighth its diameter.

The apparatus is very compact and light, allowing it to be installed easily in domestic buildings and small vehicles. The apparatus is completely self-contained, requiring only an external power supply, and it is therefore easy and cheap to install. The apparatus also has very few moving parts and it is therefore reliable, inexpensive to manufacture and easy to maintain. The wheel includes all the components of the heat pump, and can be manufactured as a sealed, maintenance-free unit.

Advantageously, the compressor is driven by rotation of the wheel, thereby avoiding the need for separate drive means. Preferably, the compressor is arranged at the periphery of the wheel and is driven via a fixed eccentric element at the centre of the wheel. The eccentric element may be a cam, a crank or any other equivalent mechanical device.

Advantageously, the compressor comprises a cylinder having a piston mounted for reciprocating movement therewithin.

Advantageously, the wheel includes a plurality of compressors, spaced equi-angularly about the periphery of the wheel, and the compressors are preferably connected to a common cooling portion and a common radiator portion. By increasing the number of compressors, the power of the heat pump can be increased without increasing the size of the apparatus. Spacing the compressors equi-angularly around the periphery of the wheel and connecting them to a common cooling portion and a common radiator portion helps to ensure that vibrations are not caused in the wheel as it rotates.

Advantageously, the radiator portion comprises a condenser means and the cooling potion comprises an evaporator means.

Advantageously, the housing has first inlet and outlet vents, second inlet and outlet vents, and a guide means adjustable between a first position in which air passing over the cooling portion of the wheel is caused to flow through the first vents and air passing over the radiator portion is caused to flow through the second vents, and a second position in which air passing over the cooling portion is caused to flow through the second vents and air passing over the radiator portion is caused to flow through the first vents. The first vents may be connected to the exterior of the building or vehicle, and the second vents may be connected to the interior of the building or vehicle. By selecting the appropriate position of the guide means, the heating or cooling apparatus can then be used to provide either cooled or warmed air.

Advantageously, the fins are thermally conducting, to assist the transference of heat between the heated and cooled portions of the wheel and the air.

The apparatus may include a motor, for driving the wheel in rotation, which motor may be mounted on the wheel.

An embodiment of the invention will now be described, by way of example, with reference to the accompanying drawings, of which:

Figure 1:
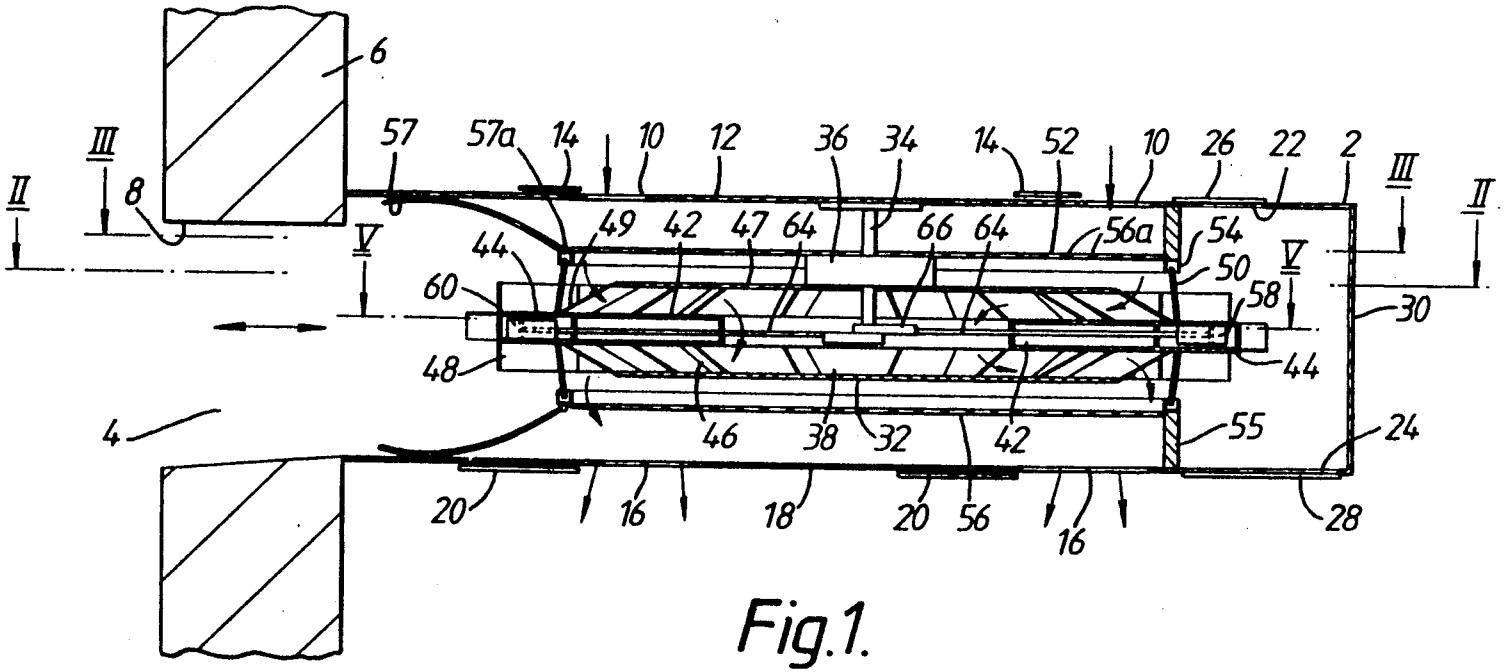
FIG. 1 is a side view, in cross section, of the heating or cooling apparatus.
Figure 2:
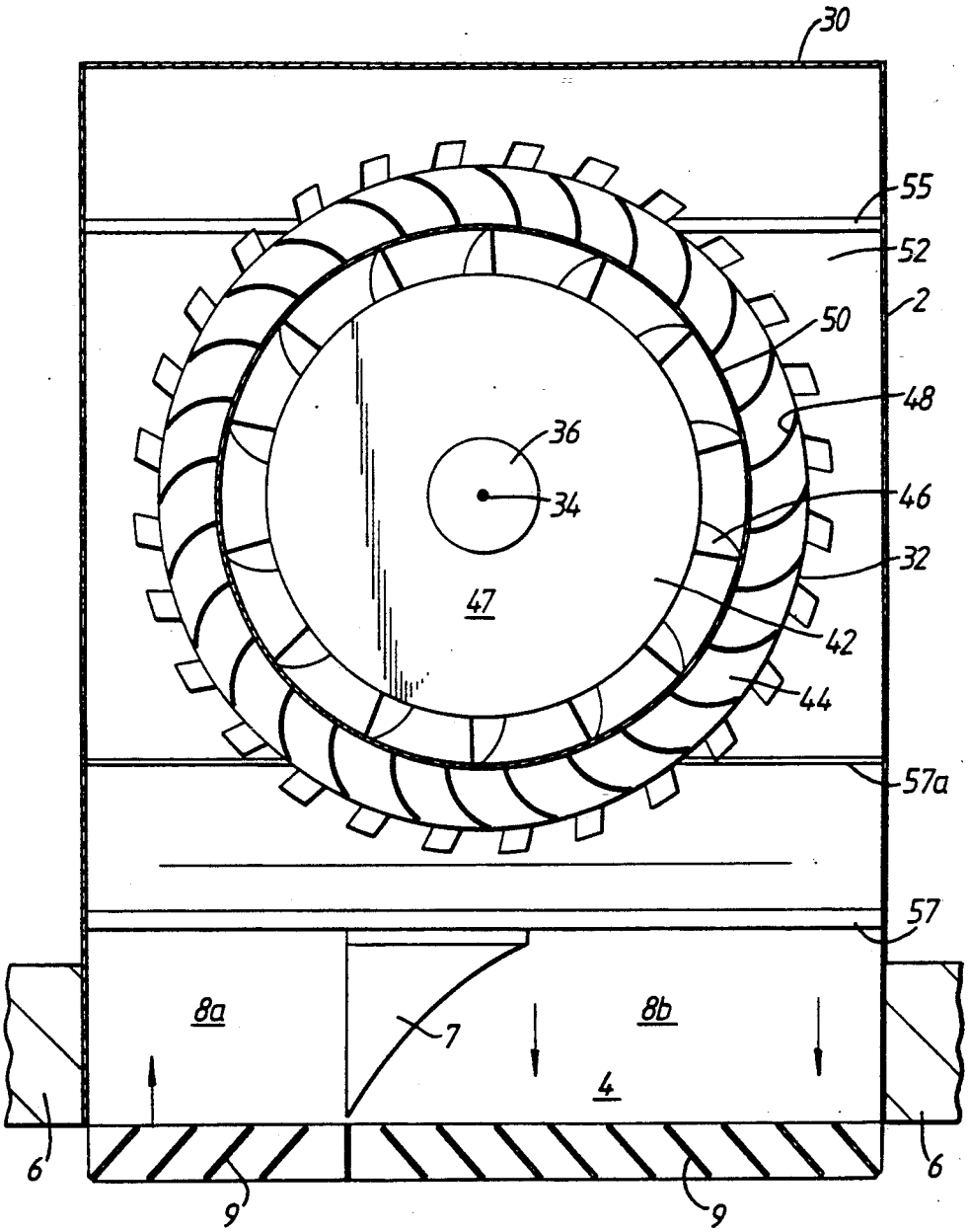
FIG. 2 is a cross section on line II—II of FIG. 1.

As shown in FIG. 1, the heating or cooling apparatus includes a substantially rectangular housing 2 having one open side 4. The apparatus is attached, in use, to the interior of a wall 6, with the open side 4 aligned with an opening 8 in the wall 6. As shown in FIG. 2, a curved guide plate 7 is provide in the opening 8 of the wall 6, and divides the opening into an inlet vent 8*a* for external air and an outlet vent 8*b*. Vanes 9 are provided in the vents 8*a*, 8*b* to guide the air streams flowing through the two vents away from one another.

The housing 2 has two primary air inlets 10 for internal air in its top surface 12, which vents may be closed by sliding flaps 14. Two primary internal air outlets 16, which are approximately twice the size of the inlets 10, are provided in the bottom surface 18 of the housing 2, and may be closed by flaps 20. A secondary internal air inlet 22 and a secondary internal air outlet 24, having sliding closure flaps 26, 28, are also provided in the top and bottom surfaces 12, 18 of the housing, towards the side 30 of the housing that is remote from the open side 4. The inlet opening 22 is approximately half the size of the outlet opening 24, and is located slightly further away from the remote side 30.

A rotary heat pump device, constructed in the form of a wheel 32, is rotatably mounted on an axle 34 which defines an axis of rotation that extends vertically downwards from the top surface 12 of the housing 2. A motor 36 is secured to the wheel 32, and arranged to drive it in rotation about the axle 34.

The wheel 32 has an open centre 38, and its outer part is divided radially into an inner, cooling portion 42 and an outer, radiator portion 44. The cooling and radiator portions 42, 44 are each provided with fins 46, 48 which help to transfer heat between the cooling and radiator portions of the wheel 32 and the surrounding air, and are shaped to force air around and through the wheel as it rotates.

A circular plate 47 is attached to the fins 46 on each side of the inner, cooling portion 42 of the wheel 32, so that only the radially outermost edges 49 of the fins are exposed. A plurality of air channels are thereby formed between the fins 46, the plates 47 and the wheel 32. The fins 46 are shaped so that when the wheel 32 rotates, air flows inwardly, towards the axle 34, on the upper side of the wheel, through the open centre 38, and then outwardly, away from the axle, on the lower side of the wheel.

The fins 48 on the outer portion 44 of the wheel are shaped to cause air to flow downwardly and outwardly, away from the axle 34, as the wheel rotates.

A cylindrical wall 50, provided on each side of the wheel 32, divides the cooling portion 42 from the radiator portion 44. The wall is inclined slightly inwardly, to trap droplets of water that condense on the cooling portion 42 of the wheel 32. The wall 50 and the fins 46,48 are provided near their bases with drainage holes (not shown) to allow trapped water to escape to the edge of the wheel and evaporate.

Located above and below the wheel 32, between the wheel and each face 12,18 of the housing 2, is an inner dividing wall 52. Each dividing wall 52 has on its inner surface a circular channel 54, which encloses and cooperates with the edge of the cylindrical wall 50 to divide the space surrounding the cooling portion 42 from the space surrounding the radiator portion 44. The inner walls 52 are each joined to the adjacent surface of the housing 2 by a vertical wall 55, which extends across the width of the housing near, and parallel to, its remote side 30.

Figure 3:
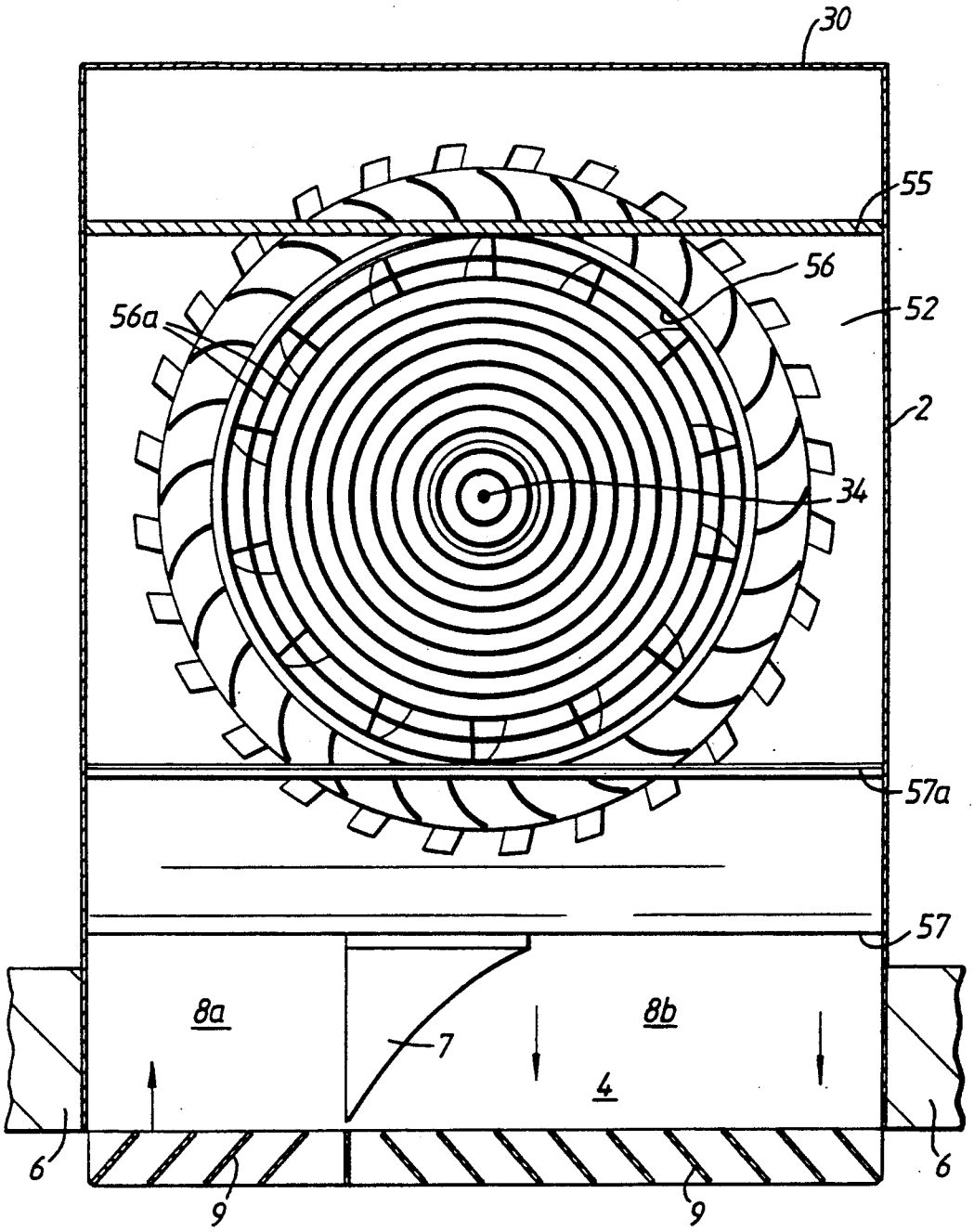
FIG. 3 is a cross section on line III—III of FIG. 1.

Each dividing wall 52 has an circular opening 56, which is concentric with, and slightly smaller in diameter than, the circular channel 54, and through which air can flow to or from the inner portion 42 of the wheel 32. The openings 56 are covered by circular vanes 56*a* (shown most clearly in FIG. 3), which prevent external objects or fingers coming into contact with the rotating wheel 32. The vanes create turbulence in the air as it flows through them, which assists the transference of heat from the air to the cooling portion 42 of the wheel.

A curved flap 57 is attached by a hinge 57*a* to the edge of each dividing wall 52 that is nearest to the open side 4 of the housing 2. The flaps 57 can be positioned against the top and bottom surfaces 12,18 of the housing 2, as shown FIG. 1, to form a boundary between the opening 8 in the wall 4 and the inner, cooling portion 42 of the wheel 32. When the flaps are arranged in that position, only external air, drawn through the opening 8 in the wall 6, comes into contact with the outer, radiator portion 44 of the wheel, and only internal air, drawn through the primary inlet openings 10, comes into contact with the inner, cooling portion 42 of the wheel.

Figure 4:
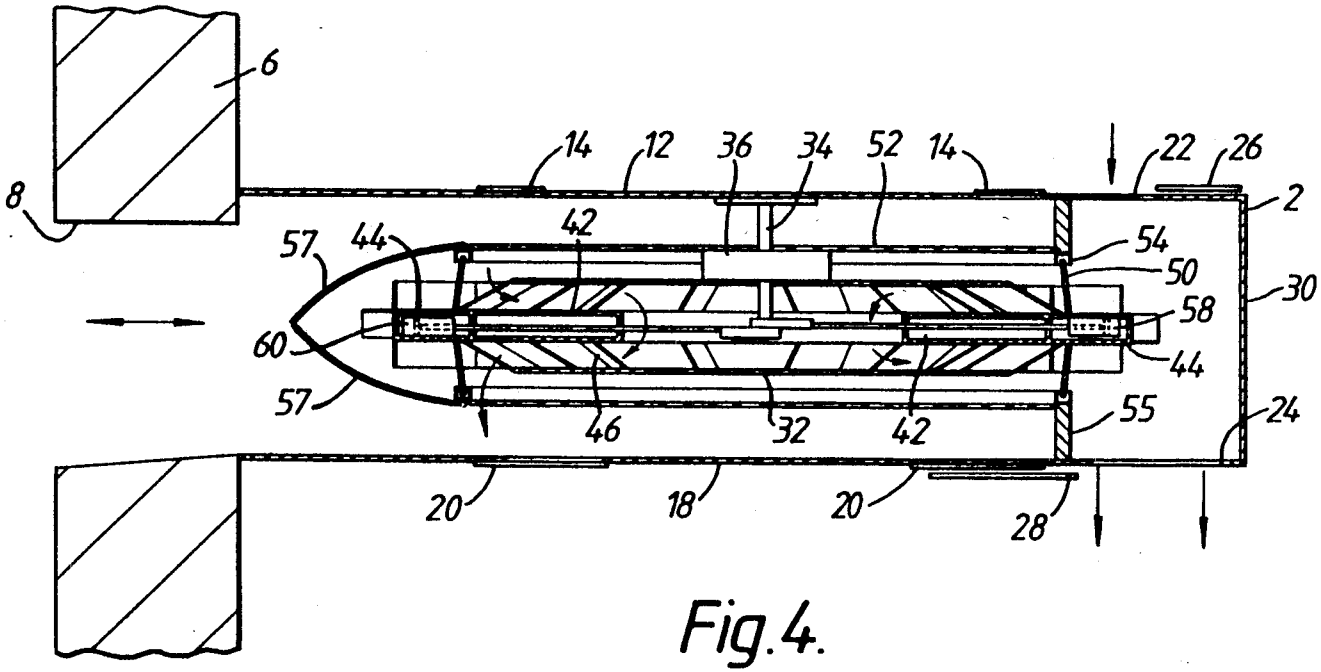
FIG. 4 is a side view, in cross section, showing the heating or cooling apparatus in a different operating configuration.

Alternatively, the flaps 57 can be pivoted towards one another, to isolate the outer, radiator portion 44 of the wheel 32 from the opening 8 in the wall 6. If, as shown in FIG. 4, the flaps 14,20 of the primary inlet and outlet vents 10,16 are simultaneously closed and the flaps 26,28 of the secondary inlet and outlet vents 22,24 are opened, then external air will come into contact only with the inner portion 42 of the wheel, and internal air, drawn through the secondary inlet opening 22, will come into contact only with the outer, radiator portion 44 of the wheel. The flow of air over the radiator and cooling portions of the wheel 32 can therefore be controlled using the flaps 14,20 and 57.

Figure 5:
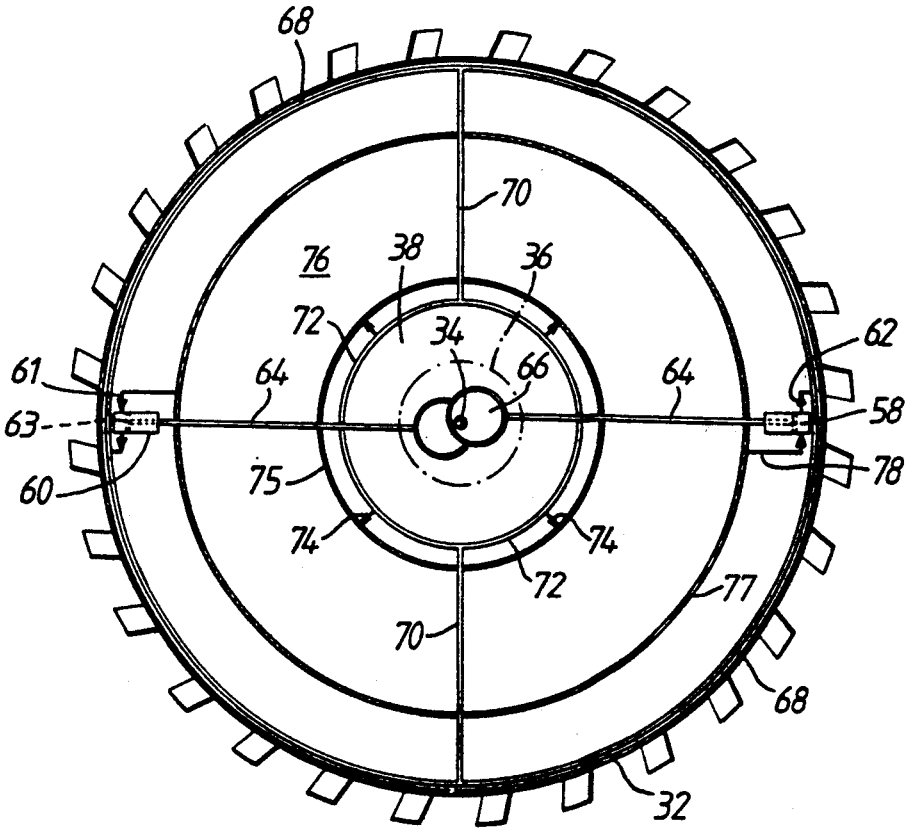
FIG. 5 is a cross section on line V—V of FIG. 1.

The internal construction of the heat pump is shown in FIG. 5. The heat pump includes a pair of compressor units 58, arranged on opposite sides of the wheel 32. Each compressor unit 58 includes a cylinder 60, having an inlet valve 61 and an outlet valve 62, and a piston 63, which is connected by a piston rod 64 to an eccentric 66 on the axle 34. When the wheel rotates, the eccentrics 66 cause the pistons 63 to reciprocate.

A circular pipe 68, which forms the condenser of the heat pump, extends around the periphery of the wheel 32 and is connected to the outlet valves 62 of the compressors 58. A pair of branch pipes 70 are connected to the circular pipe 68 on each side of the wheel at points midway between the two cylinders 60, and extend radially inwards towards the centre of the wheel. The branch pipes 70 are connected at their inner ends to a second circular pipe 72, which lies adjacent to the inner cylindrical wall 75 of an annular chamber 76, which forms the evaporator of the heat pump. Four equi-angularly spaced expansion valves 74 connect the pipe 72 with the interior of the annular chamber 76, and a pair of outlet pipes 78 extend radially outwards from the outer cylindrical wall 77 of the chamber 76, and are connected to inlet valves 61 of the compressor units 58. The condenser (the first circular pipe 68) is in thermal contact with the radiator portion 44 of the wheel 32, and the evaporator (the expansion chamber 76) is in thermal contact with the cooling portion 42. A refrigerant is contained within the compressors 58, the pipes 68,70,72 and the chamber 76.

The wheel rotates about the axis of rotation with the condenser, expansion valve, evaporator and compressor lying in a plane orthogonal to the axis of rotation. When the wheel rotates, the pistons 63 compress the refrigerant and force it through the outlet valves 62 into the first circular pipe 68. The heat generated by the compression of the refrigerant is dissipated by the fins 48 on the radiator portion 44, allowing the refrigerant to cool and condense. The liquid refrigerant then flows through the pipes 68,70,72 and passes through the expansion valves 74 into the annular chamber 76. As the refrigerant expands it evaporates, drawing heat from the cooling portion 42 of the wheel 32 and thereby reducing its temperature. The gaseous refrigerant returns to the compressors 58 via the outlet pipes 78 and compressor inlet valves 61.

Operation of the heating or cooling apparatus is as follows. When cooling is required, the flaps 14, 20, 26, 28 and 56 are positioned as shown in FIG. 1. The fins 48 on the outer portion 44 of the wheel 32 then cause the air in the housing 2 to circulate, which draws external air into the housing 2 through the inlet opening 8*a* and expels it, due to centrifugal action, through the outlet opening 8*b*. Heat is thereby dissipated from the condenser to the external air.

The rotation of the wheel 32 also causes internal air to be drawn through the primary inlet vents 10 by the fins 46 on the inner portion 42 of the wheel, and expelled through the primary outlet vents 16. That air is cooled as it flows through the wheel 32, and the extracted heat is expelled to the exterior by the radiator portion 44. The temperature and the quantity of cool air supplied to the interior of the building can be controlled by adjusting the speed of the motor 36 and the sizes of the primary air inlet and outlet vents 10,16.

If heating of the building is required, the flaps 14,20,22,24 and 56 are arranged as shown in FIG. 6. External air is then drawn through the inner cooling portion 42 of the wheel 32, and heat is extracted from it. That heat is transferred by the heat pump to the outer, radiator portion 44 of the wheel, causing its temperature to rise significantly above the ambient temperature. Internal air is drawn through the secondary inlet vent 22 by the fins 48 on the radiator portion of the wheel, and the warmed air is then expelled into the building through the secondary air outlet 24.

Various modifications of the apparatus are of course possible. For example, instead of providing a motor, the heating or cooling apparatus can be driven by any external drive mechanism such as, for example, a windmill. The apparatus can therefore be used even where an electricity supply is not available.

The apparatus can be manufactured in a variety of different sizes, suitable for installation in a large factory, a domestic house or a lorry or small car. If greater power is required, this can be provided without increasing the size of the apparatus, by increasing the number of compressor units.

Instead of fixing the eccentric elements which drive the compressors directly to the axle, they can be connected to axle via a clutch. By disengaging the clutch and/or altering the positions of the flaps on the housing, the apparatus can be operated without driving the heat pump, to provide a supply of fresh external air. Temporarily disengaging the clutch, so that the heat pump is not driven, also allows the wheel to accelerate quickly to its operating speed, as the resistance of the compressors does not then have to be overcome. Another way of increasing the initial acceleration of the wheel is to provide the compressors with by-pass valves, which open automatically when the rotational speed of the wheel is below a predetermined value, to prevent pressurisation of the refrigerant. Such valves could, for example, be centrifugally operated.

I claim:

1. A heating or cooling apparatus including a heat pump comprising a compressor, a radiator portion, an expansion valve and a cooling portion, the heat pump being constructed in the form of a rotatable member wherein the cooling portion forms a radially inner portion of the member and the radiator portion forms a radially outer portion of the member, the member having a plurality of fins which, when the member rotates, drive streams of air over the cooling portion and the radiator portion, and a housing enclosing the member and having means for separating the streams of air and directing them in desired directions, the rotatable member being formed as a wheel which rotates about an axis of rotation, with the radiator portion, the expansion valve, the cooling portion and the compressor lying substantially in a plane orthogonal to said axis of rotation.

2. An apparatus according to claim 1, wherein the compressor is driven by rotation of the wheel.

3. An apparatus according to claim 2, wherein the compressor is arranged at a periphery of the wheel and is driven via a fixed eccentric element at a centre of the wheel.

4. An apparatus according to claim 3, in which the compressor comprises a cylinder having a piston mounted for reciprocating movement therewithin.

5. An apparatus according to claim 4, in which the wheel includes a plurality of compressors, spaced equiangularly about the periphery of the wheel.

6. An apparatus according to claim 5, in which the compressors are connected to a common cooling portion and a common radiator portion.

7. An apparatus according to claim 6, wherein the radiator portion comprises a condenser means and the cooling portion comprises an evaporator means.

8. An apparatus according to claim 7, in which the housing has first inlet and outlet vents, second inlet and outlet vents, and a guide means adjustable between a first position in which air passing over the cooling portion of the wheel is caused to flow through the first vents and air passing over the radiator portion is caused to flow through the second vents, and a second position in which air passing over the cooling portion is caused to flow through the second vents and air passing over the radiator portion is caused to flow through the first vents.

9. An apparatus according to claim 8, in which the fins are thermally conducting.

10. An apparatus according to claim 9, including a motor, for driving the wheel in rotation.

11. An apparatus according to claim 10, in which the motor is mounted on the wheel.

* * * * *

UNITED STATES PATENT AND TRADEMARK OFFICE

CERTIFICATE OF CORRECTION

PATENT NO. : 5,315,844

DATED : May 31, 1994

INVENTOR(S) : Laurits Hansen

It is certified that error appears in the above-indentified patent and that said Letters Patent is hereby corrected as shown below:

On the title page, item [76] the third line of the inventor's address, delete "Denmark"

Signed and Sealed this

Twenty-seventh Day of December, 1994

*Attest:*

Bruce Lehman

BRUCE LEHMAN

*Attesting Officer*

*Commissioner of Patents and Trademarks*